US006123651A

United States Patent [19]

Ellenburg

[11] Patent Number: 6,123,651

[45] Date of Patent: Sep. 26, 2000

[54] BARBELL HOLDER AND METHODS FOR ITS USE

[75] Inventor: Howard S. Ellenburg, Boulder, Colo.

[73] Assignee: Ultima Fitness, Inc., Denver, Colo.

[21] Appl. No.: 09/028,604

[22] Filed: Feb. 24, 1998

[51] Int. Cl.[7] ..... A63B 21/075

[52] U.S. Cl. ..... 482/104; 482/108

[58] Field of Search ..... 482/50, 93, 94, 482/101, 104–108, 139; 211/4

[56] References Cited

U.S. PATENT DOCUMENTS

| | | | |
|---|---|---|---|
| 2,214,052 | 9/1940 | Good | 482/105 |
| 4,113,107 | 9/1978 | Jaeger | 211/4 |
| 4,750,739 | 6/1988 | Lange | 482/101 |
| 4,836,535 | 6/1989 | Pearson | 482/101 |
| 5,346,449 | 9/1994 | Schlagel | 482/107 |

FOREIGN PATENT DOCUMENTS

| | | | |
|---|---|---|---|
| 738579 | 10/1932 | France | 482/104 |

*Primary Examiner*—John Mulcahy
*Attorney, Agent, or Firm*—Townsend and Townsend and Crew LLP

[57] ABSTRACT

The invention provides an exemplary barbell holder and methods for its use. In an exemplary embodiment, a barbell holder comprises a base member having at least one region that is adapted to hold a weight. A coupling mechanism is operably attached to the base member. The coupling mechanism is adapted to removably couple a barbell to the base member.

19 Claims, 5 Drawing Sheets

BARBELL HOLDER AND METHODS FOR ITS USE

BACKGROUND OF THE INVENTION

The invention relates generally to the field of weight-lifting, and in particular to the storing and handling of barbells and weights. More specifically, the invention provides an exemplary carrying system for a barbell and its associated weights.

Barbells have long been a popular type of weight-lifting equipment. One type of barbell which is of particular interest to the invention is smaller sized barbells, often referred to as "dumbbells." Such barbells typically comprise a handle having two ends. Various weights may be inserted over the ends and secured to the handle with a pair of end pieces. For example, one type of exemplary barbell uses a release or quick-fit coupling to secure the end pieces to the handle. Such barbells are described in U.S. Pat. No. 5,346,449 (the '449 patent) and co-pending U.S. application Ser. No. 09/018,101, filed Feb. 3, 1998 (Attorney Docket No. 18272-2). The complete disclosures of both these references are incorporated herein by reference.

Due to the geometry and weight of barbell systems, a variety of challenges arise when displaying, transporting, organizing and storing the barbell handle and weights. For example, at present there is no convenient or efficient way to organize and display a barbell and its associated weights on a shelf, such as in a sporting goods store. Further, once a customer has selected a barbell and weights, it is difficult to carry the selected barbell and weights to a checkout stand. Similar problems are experienced when transporting the barbell and weights to various other locations, such as to a gym for a workout. Another challenging aspect of such barbell systems is the difficulty in organizing the handle and various weights so that they may be conveniently used and stored. As such, a workout or storage area is often cluttered with various weights.

Hence, it would be desirable to provide an exemplary carrying and organizing system for barbells and their associated weights. Such a system should allow for the easy and convenient organization of the barbell and weights and also facilitate their carrying, use, storage and display.

SUMMARY OF THE INVENTION

The invention provides an exemplary barbell holder and methods for its use which facilitate the use, organization, display, transportation and storage of barbells and their associated weights. In one exemplary embodiment, a barbell holder comprises a base member having at least one region for holding one or more weights. A coupling mechanism is operably attached to the base member so that a barbell may be removably coupled to the base member. In this way, the barbell holder provides a convenient and easy way to hold and organize a barbell and its associated weights. Moreover, when the barbell is coupled to the base member, the barbell serves as a convenient handle to carry the holder and weights.

The coupling mechanism preferably comprises a pair of arms that are slidably received into a pair of slots in the base member. Each arm preferably includes a hole so that the barbell may be coupled to the arms. For example, the barbell may comprise a handle and a pair of end pieces. In this way, the handle may be disposed between the arms and the end pieces inserted through the holes and into the handle to couple the barbell to the arms. Conveniently, one or more weights may also be coupled to the handle so that both the barbell and weights are secured to the base member.

In one exemplary aspect, each arm includes a ridge and each slot includes a stop. In this way, the stops engage the ridges to limit upward travel of the arms relative to the base member. With such a configuration, the barbell holder may be used in a variety of ways to facilitate the transport, use, carrying, and organization of a barbell. For example, in a storage position, the handle is disposed near the base member to minimize the overall dimensions of the holder. When ready to transport the holder, the handle is grasped and lifted. As the handle is lifted, the arms move away from the base member until the ridges engage the stops. In this way, grasping of the handle and carrying of the holder is facilitated.

Once the barbell and any weights are removed from the arms, the arms may be slid further into base member so that a convenient surface is provided for placing a barbell and any attached weights. Such a configuration is conveniently referred to as a use position and is particularly advantageous during a workout where a user may rest the barbell and weights on the base member between sets. The weight receiving region of the base member preferably comprises one or more shelves. Further, each shelf may hold one or more weights. In a convenient arrangement, the base member includes a top end and a bottom end, with the top end having an aperture. In this way, a pin member may be provided which is slidable through the aperture and through a hole in a weight that is stored on the shelf. In this way, the weight is removably coupled to the shelf until the pin member is removed. When provided with multiple shelves, each shelf may be provided with an aperture so that the pin member may be slid through the apertures to couple the weights on each shelf to the base member. Conveniently, the pin member may include a rim at a proximal end to engage the top end of the base member when the pin member is inserted through the apertures. In this way, travel of the pin member relative to the base member is stopped. Optionally, the pin member may have a tapered distal end to ease its insertion through the holes of the weights.

In still a further aspect, the top end of the base member may include a recessed region which is adapted to hold a portion of a barbell. In this way, the portion of the barbell will be secured to the base member to facilitate the coupling of weight to the barbell.

DETAILED DESCRIPTION OF THE SPECIFIC EMBODIMENTS

The invention provides an exemplary carrying or caddy system for barbells and weights. The system of the invention provides a convenient and efficient way to display, organize, transport, use and store a barbell and its associated weights. Although useful with a wide variety of commercially available barbell or dumbbell systems, the invention will find its greatest use with barbells having a quick connect system for removing the weights. Such a system is described generally in the '449 patent and co-pending U.S. application Ser. No. 09/018,101, filed Feb. 3, 1998, previously incorporated by reference.

Briefly, such barbell systems comprise a tubular handle and a pair of plunger pieces which are insertable into the ends of the handle. A collar is provided at each end of the handle for securing the plunger pieces to the handle. With such a configuration, the user is able to attach a ring-shaped weight to the handle by inserting one of the plunger pieces through the weight and then inserting the plunger piece into the handle. Each plunger piece is advanced into the handle until the collar engages a set of balls to grip the plunger piece, thereby securing the plunger piece to the handle.

Turning now to FIGS. 1–4, an exemplary embodiment of a barbell holder 10 will be described. Barbell holder 10 comprises a base member 12 having a pair of shelves 14 and 16. Each shelf 14, 16 is adapted to hold one or more weights which in turn may be coupled to a barbell as described in greater detail hereinafter. Although shown with only two shelves, it will be appreciated that base member 12 may be provided with additional shelves depending on the number of weights that are to be held by base member. Further, the size of the additional shelves may be the same or larger than shelves 14 and 16 so that larger weights may be carried by base member 12. Preferably, base member 12 is constructed of a rigid and durable material, such as ABS or nylon plastics. Alternative materials that may be used to construct base member 12, include other plastics, wood, metals, composites, and the like.

Figure 3:
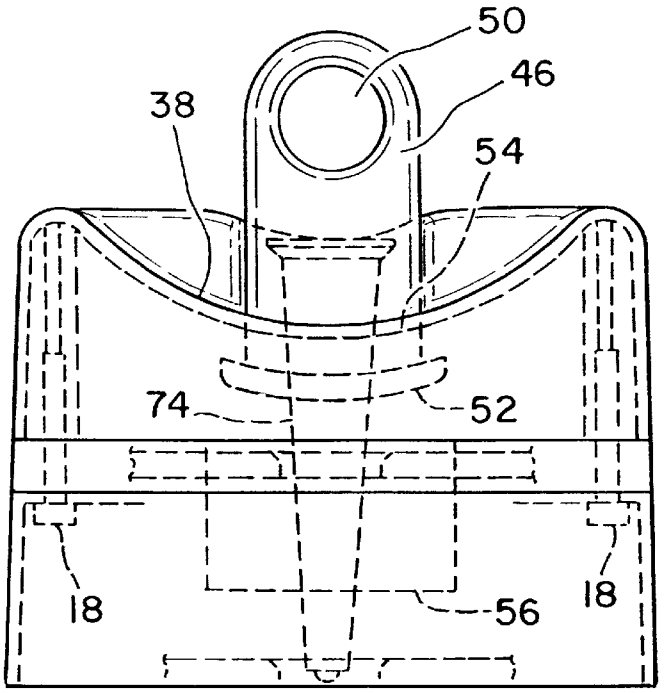
FIG. 3 is an end view of the holder of FIG. 1.
Figure 2:
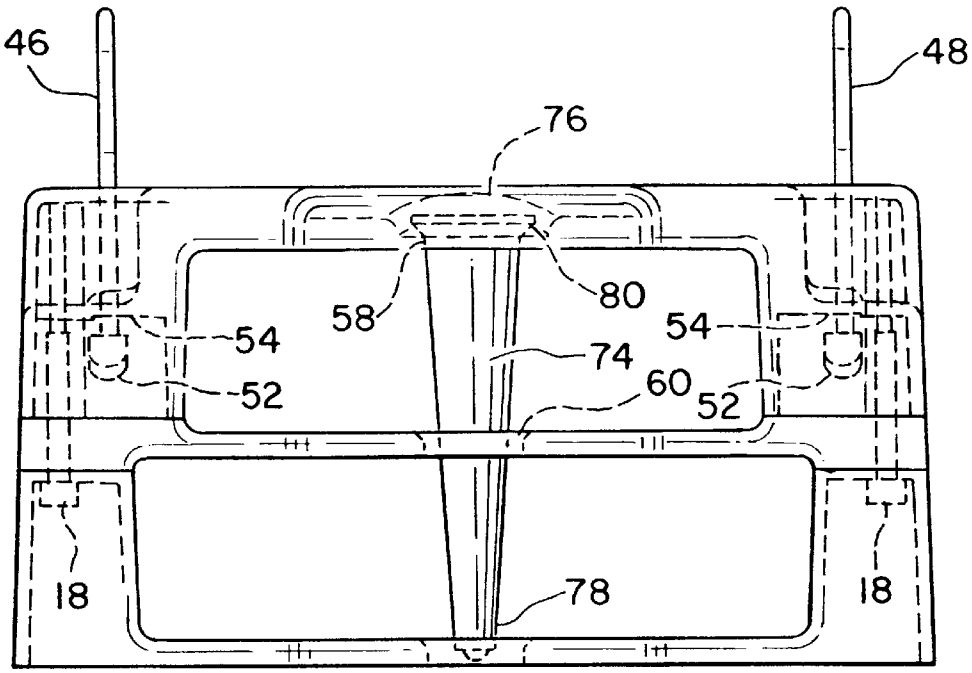
FIG. 2 is a side view of the holder of FIG. 1.

For convenience of manufacture, base member 12 may be constructed of a variety of sections which are secured together with a pair of bolts 18 (see FIGS. 2 and 3). Additional sections may be added to provide more shelves by merely attaching the additional sections in a similar manner. As an alternative to using bolts 18, a variety of securing mechanisms may be provided, including snaps, adhesives, clips, and the like.

Base member 12 includes a top end 20, a bottom end 22 and four sides 24–30. Shelves 14 and 16 preferably extend between sides 26 and 30, although one of the sides could be closed. Conveniently, sides 26 and 30 each include a circular recess 32 and 34 to facilitate grasping of a weight for removal from base member 12. Conveniently, top end 20 includes a groove 36 to facilitate grasping of handle of a barbell (not shown) as described in greater detail hereinafter. Top end 20 further includes a pair of arced regions 38 and 40 which are for receiving end pieces of a barbell or any weights which are attached to a barbell as described hereinafter.

Base member 12 further includes a pair of slots 42 and 44 (see FIGS. 1 and 4) extending through arced regions 38 and 40, respectively. Slidably disposed in slots 42 and 44 are arms 46 and 48, respectively. Each arm 46, 48 includes a hole 50 which allows a barbell to be coupled to arms 46, 48. Arms 46 and 48 also include a ridge 52 which engages a stop 54 (see FIGS. 2 and 3) within base member 12 to limit the upward travel of arms 46 and 48. In this way, when a barbell is coupled to arms 46 and 48 and the handle of the barbell is grasped and lifted, arms 46 and 48 will travel upward until ridges 52 engage stops 54. When a barbell is not coupled to arms 46 and 48, arms 46 and 48 will move by force of gravity to rest on surfaces 56 (see FIG. 3). In this way, arms 46 and 48 will not interfere with a loaded barbell which is rested on regions 38 and 40 as described hereinafter.

Figure 1:
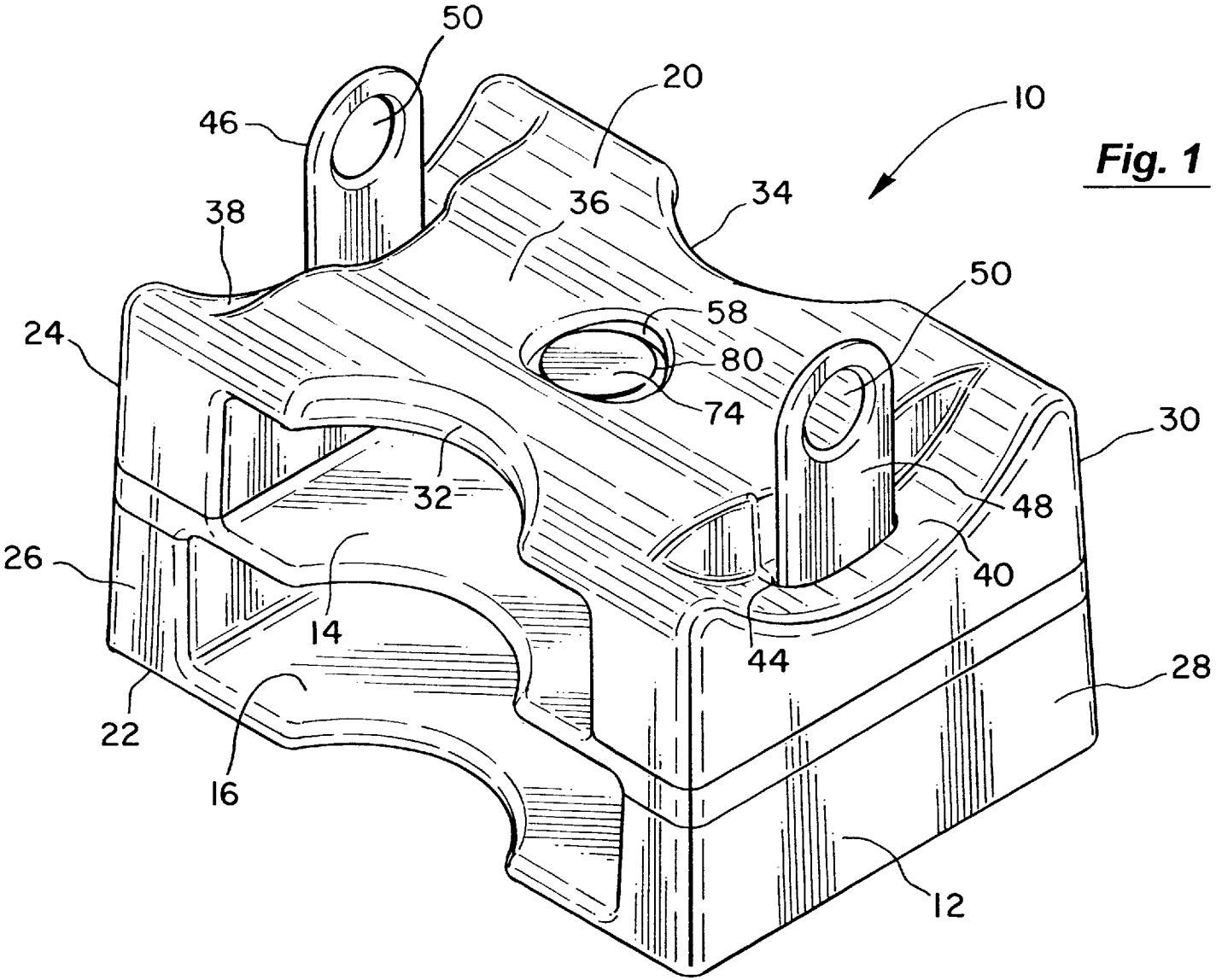
FIG. 1 is a perspective view of an exemplary barbell holder according to the invention.
Figure 4:
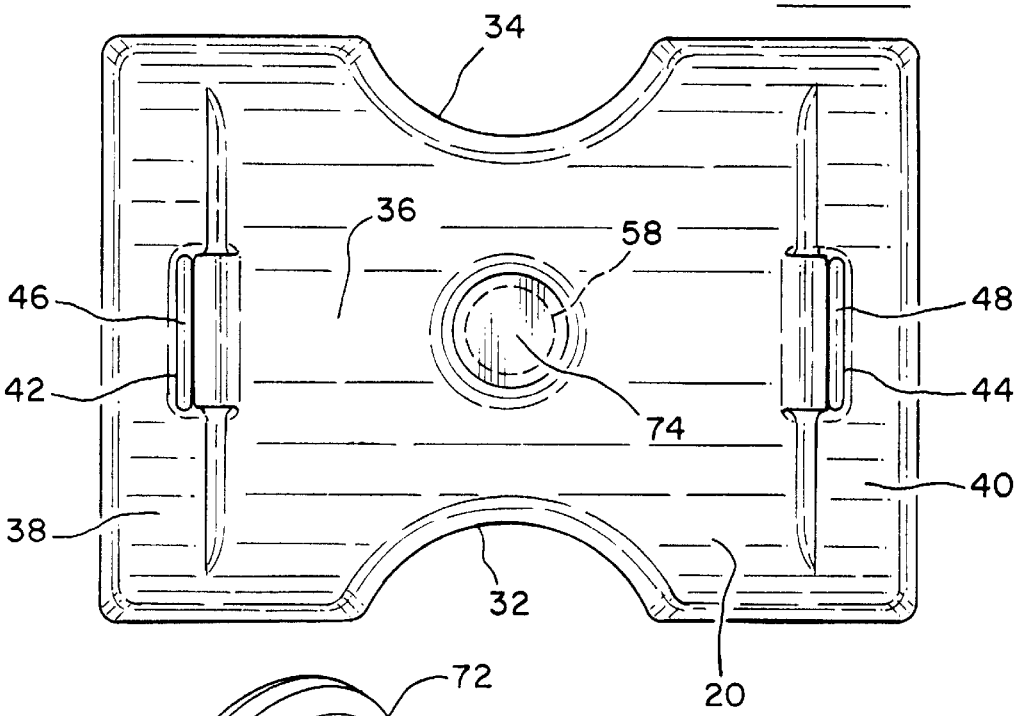
FIG. 4 is a top view of the holder of FIG. 1.

As best shown in FIGS. 1 and 4, top end 20 includes an aperture 58. Shelf 14 further includes an aperture 60 (see FIG. 2) which is aligned with aperture 58. In this way, a pin 74 may be inserted through the apertures 58 and 60 to secure any weights to shelves 14 and 16 as described in greater detail hereinafter.

Optionally, aperture 58 (or another recessed region which is provided on top end 20) may include a detent so that an end piece or plunger piece of a barbell may be secured to top end 20. When properly secured, a weight may be placed on the plunger piece and the handle of the barbell inserted over the plunger piece to couple the plunger piece and weight to the handle. Once properly coupled, a force may be applied to the barbell to remove it from top end 20. In this way, a convenient way is provided to attach weights to a barbell in a safer manner.

Figure 5:
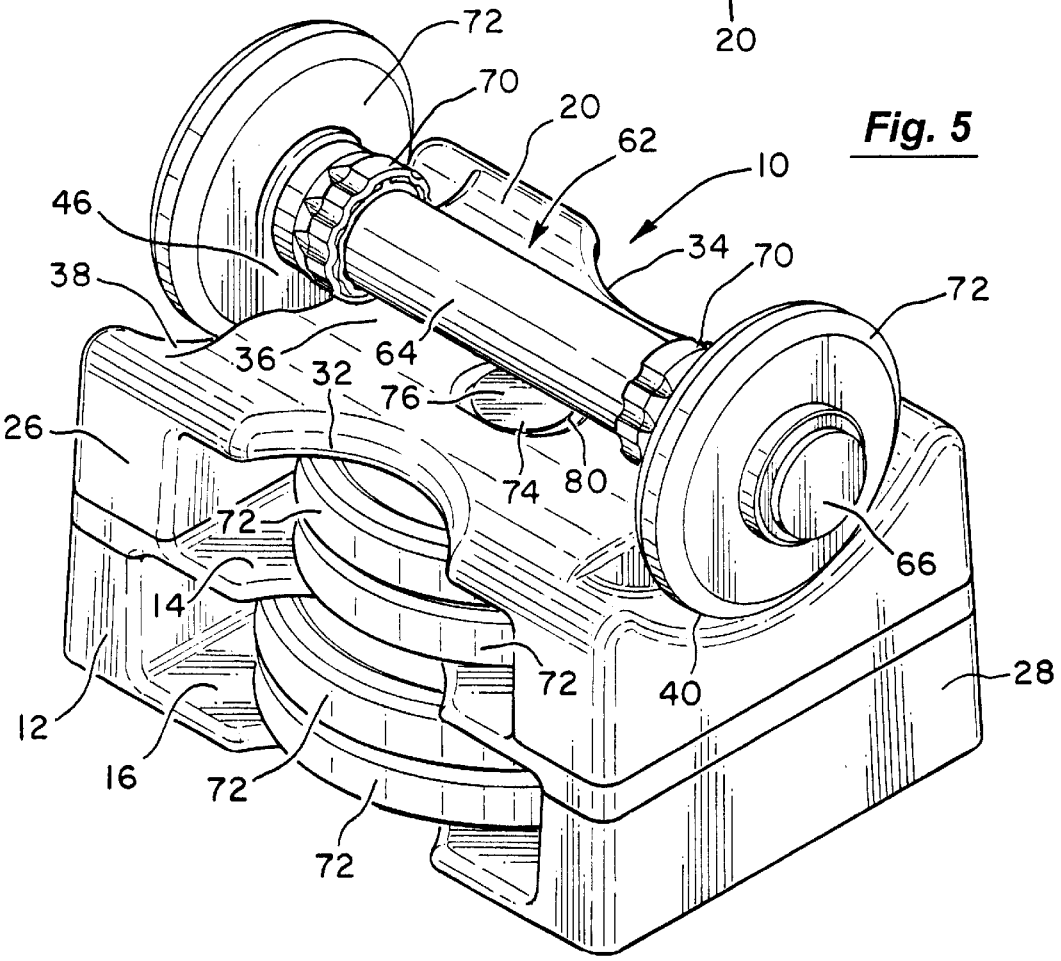
FIG. 5 illustrates the barbell holder of FIG. 1 having a barbell and a plurality of weights coupled thereto according to the invention.

Referring now to FIG. 5, coupling of a barbell 62 to barbell holder 10 will be described. Barbell 62 comprises a tubular handle 64 and a pair of end pieces 66 (one being hidden from view). Barbell 62 further includes a pair of collars 70 which are employed to couple end pieces 66 to handle 64 as described in the '449 patent and co-pending application Ser. No. 09/018,101, filed Feb. 3, 1998, previously incorporated by reference.

To couple barbell 62 to holder 10, end pieces 66 are removed from handle 64. Handle 64 is then placed between arms 46 and 48 and end pieces 66 are inserted through holes 50 and into handle 64 until collar 70 securely couples end pieces 66 to handle 64. Optionally, one or more weights 72 may be also be coupled to handle 64 by inserting end pieces 66 through weights 72 prior to insertion through holes 50. When weights 72 are coupled to handle 64, weights 72 are held in arced regions 38 and 40. In this way, weights 72 serve as spacers to keep handle 64 spaced apart from top end 20. As described in greater detail hereinafter, since arms 46 and 48 are slidable relative to base member 12, handle 64 can conveniently be grasped by lifting handle 64 to further separate it from top end 20.

To remove handle 64, coupling mechanisms 70 are operated and end pieces 66 are removed from handle 64 and arms 46 and 48. Weights 72 may then be stored on one of shelves 14 or 16, or replaced on handle 64.

Still referring now to FIG. 5, coupling of weights 72 to base member 12 will be described. As shown, shelves 14 and 16 are sized differently to accommodate different sized weights. For example, shelf 14 may be provided with one or more 2½-pound weights, while shelf 16 holds one or more 5 pound weights. As previously described, additional shelves may be provided to hold more, and optionally larger sized, weights.

Extending through aperture 58 and aperture 60 is pin 74. Pin 74 has a proximal end 76 and a distal end 78 (see FIG. 2). Distal end 78 is tapered to facilitate insertion of pin 74 through the center hole of each weight 72. Proximal end 76 includes a rim 80 which engages with top end 20 of base member 12 to limit travel of pin 74 into base member 72. When pin 74 is fully inserted, weights 72 are secured to base member 12. To remove a weight, pin 74 is simply removed from base member 12 and weights 72 are slid from shelves 14 and 16. Conveniently, when barbell 62 is coupled to base member 12, handle 64 prevents removal of pin 74 so that weights 72 will remain secured within shelves 14 and 16.

Figure 6B:
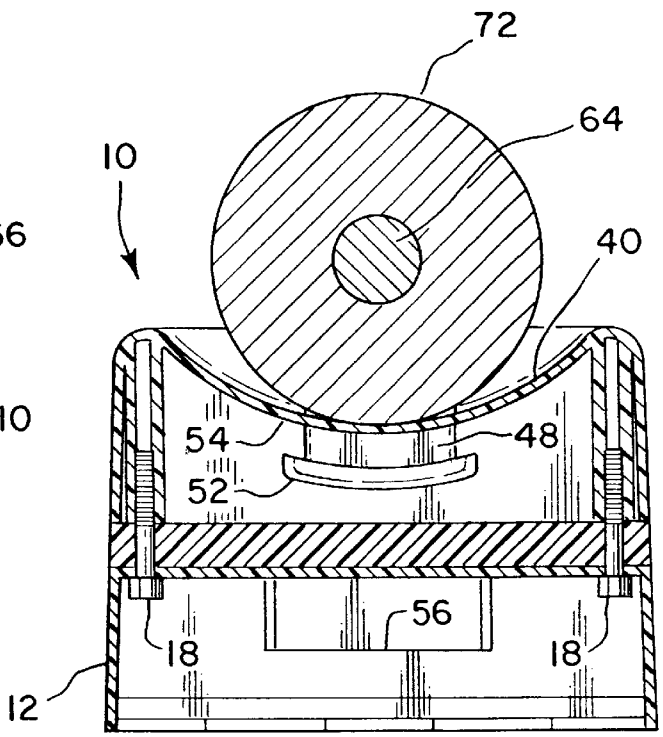
FIG. 6B is a cross-sectional end view of the holder of FIG. 6A taken along lines B—B.
Figure 6A:
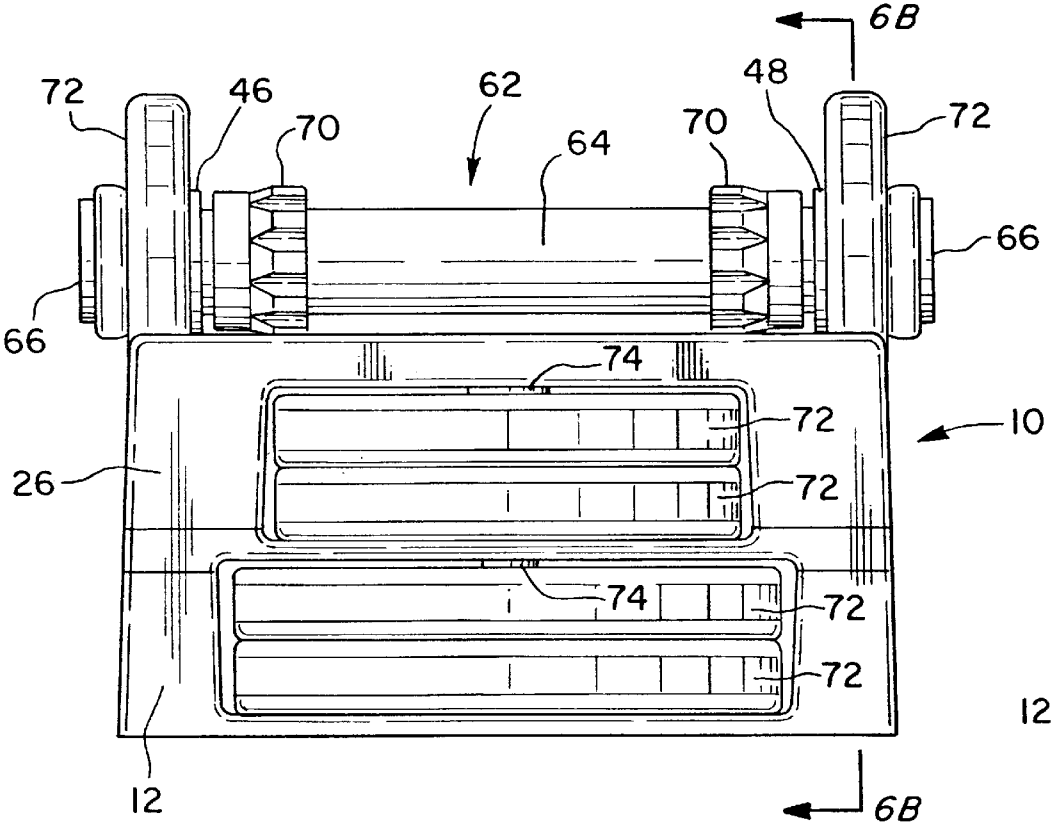
FIG. 6A is a side view of the holder of FIG. 5 in a storage position.

Referring now to FIGS. 6A, 6B, 7 and 8, the various functional positions of barbell holder 10 will be described. As shown in FIGS. 6A and 6B, barbell holder 10 is in a storage position. In the storage position, weights 72 rest on arced regions 38 and 40 so that the overall height of the barbell is minimized. In this way, barbell holder 10 may be conveniently stored while occupying a minimal amount of space. Such a configuration is particularly advantageous in retail settings where shelving space is limited. Moreover, the compact size of barbell holder 10 also allows for convenient home storage.

Figure 7:
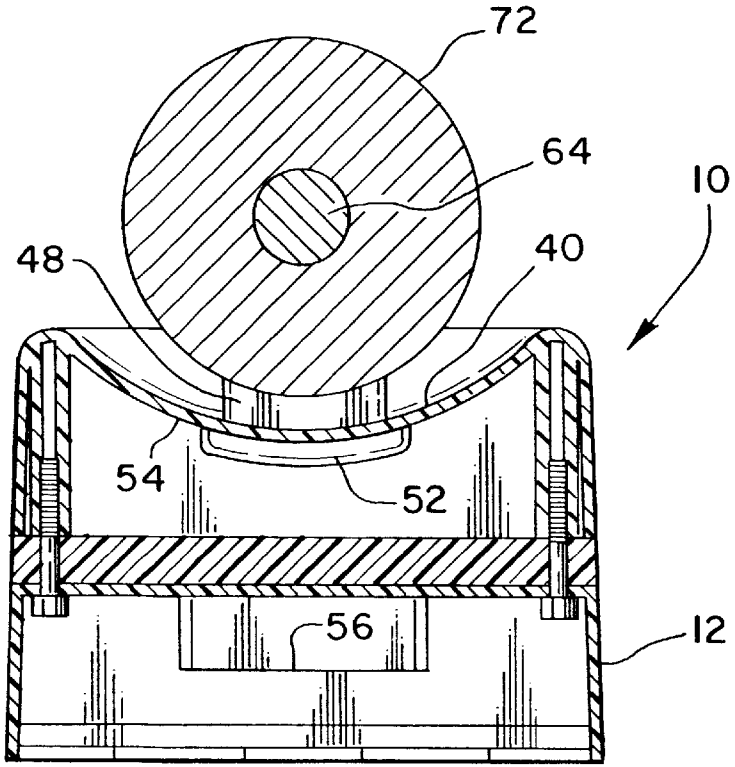
FIG. 7 illustrates the barbell holder of FIG. 6B when in a carrying position according to the invention.

As shown in FIG. 7, barbell holder 10 is in a carrying position. In the carrying position, a user (not shown) is grasping handle 64 of barbell 62 to lift barbell holder 10. As handle 64 is lifted, arms 46 and 48 are moved upward until ridges 52 engage stop 54 as previously described. In this way, handle 64 is moved away from top end 20 so that the user's hand may conveniently fit between handle 64 and top end 20. Such a configuration is advantageous in that the size of barbell holder 10 may be kept at a minimum while in the storage position of FIGS. 6A, and 6B. When ready to transport, handle 64 may easily be moved away from top end 20.

Figure 8:
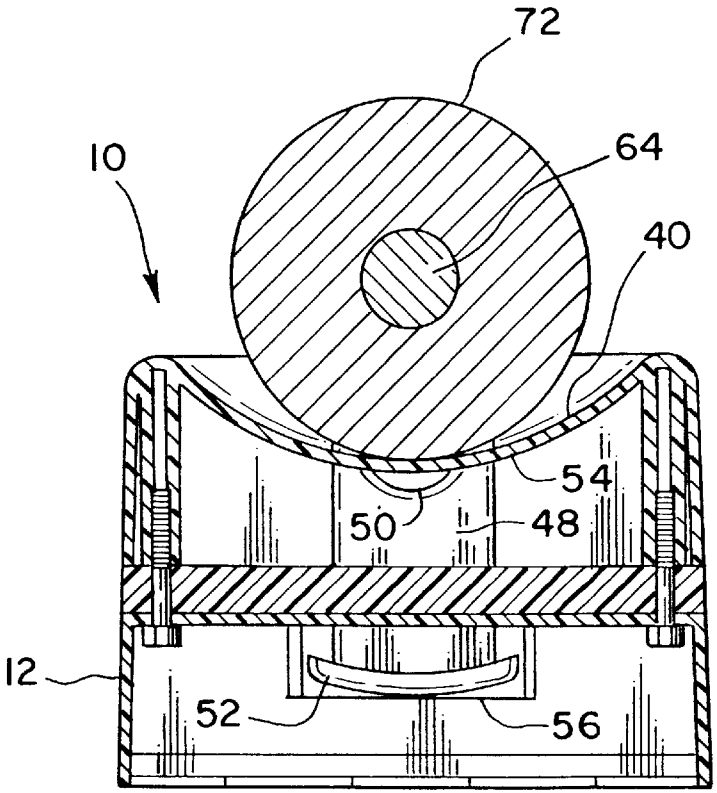
FIG. 8 illustrates the barbell holder of FIG. 6B when in a use position according to the invention.

As shown in FIG. 8, barbell holder 10 is in a used position. In such a position, barbell 62 is uncoupled from arms 46 and 48. In such a case, arms 46 and 48 slide further within base member 12 until resting on surfaces 56 as previously described. In this way, weights 72 may be rested on arced regions 38 and 40 without interfering with arms 46 and 48. With such a configuration, base member 12 serves a convenient holder for barbell 62 when not in use. For example, during a workout, base member 12 may be placed upon the floor and barbell 62 placed on base member 12.

In summary, barbell holder 10 provides a convenient and efficient way to display, organize, transport, use and store a barbell and its associated weights. The system allows for convenient organization by allowing the weights to be placed on shelves while the barbell handle is positioned on top of the base member. Further, when coupled to the base member, the handle of the barbell also serves as a convenient handle to transport the barbell holder. The weights are easily removable from the shelves so that they may be selectively coupled to the barbell to facilitate its use in various exercises. Barbell holder 10 is also useful in providing a convenient package which may be marketed using minimal shelf space and which is easy to transport to a checkout register.

The barbell holder of the invention provides additional marketing advantages by providing customers with the opportunity to see, feel, and grasp the product in its configured and assembled state. Since the barbell holder and weights are not enclosed within a box, the user is able to demonstrate and utilize the product prior to a purchase. Further, a visual image of the product and its intended use is provided to customers while the product rests on a shelf so that the usefulness of the product is readily displayed. Hence, the invention provides a cost effective and convenient way to market the barbell holder.

The invention has now been described in detail for purposes of clarity and understanding. However, it will be appreciated that certain changes and modifications may be within the scope of the invention. Therefore, the scope and content of the invention are not limited to the foregoing but should be interpreted in light of the following claims and the full range of equivalents to which those claims are entitled.

What is claimed is:

1. A portable barbell holding system, comprising:

a barbell;

a base member having a bottom end, a top end, and at least one shelf; and a pair of arms slidably received into a pair of slots in the base member so as to extend above the top end, wherein the barbell is removably coupled to the pair of arms so as to be positioned on or above the top end to permit generally unobstructed access to the barbell from above the top end when grasping the barbell, and to permit the barbell and base member to be lifted together.

2. A system as in claims 1, wherein each arm includes a hole, and wherein the barbell is received in the holes.

3. A system as in claim 2, wherein the barbell comprises a handle and a pair of end pieces, and wherein the handle is disposed between the arms and the end pieces are inserted through the holes and into the handle.

4. A system as in claim 1, wherein each arm includes a ridge, wherein each slot includes a stop, and wherein the stops engage the ridges to prevent further upward travel of the arms relative to the base member.

5. A system as in claim 1, further comprising a weight removably held on the shelf.

6. A system as in claim 5, further comprising a securing mechanism to removably secure the weight to the shelf.

7. A system as in claim 6, wherein the top end includes an aperture, and wherein the securing mechanism comprises a pin member which is slidable through the aperture and a hole in the weight.

8. A system as in claim 7, wherein the pin member includes a rim at a proximal end which engages the top end of the base member when the pin member is inserted through the aperture and the weight, and wherein the pin member has a tapered distal end.

9. A system as in claim 7, wherein the top end includes a recessed region which is adapted to hold a portion of the barbell to facilitate the coupling of a weight to the barbell.

10. A system as in claim 1, wherein the base member includes a plurality of shelves.

11. A barbell holding system, comprising:

a barbell;

a base member having at least one shelf; and a coupling mechanism operably attached to the base member, wherein the barbell is removably coupled to the base member;

wherein the base member includes a recessed region which is adapted to hold a portion of the barbell to facilitate the coupling of a weight to the barbell.

12. A portable barbell holding system, comprising:

a barbell having opposing ends;

at least one weight coupled to each end of the barbell;

a base member having at least one shelf and a pair of regions for receiving the weights when coupled to the barbell; and a coupling mechanism operably attached to the base member, wherein the barbell is adapted to removably couple the barbell to the base member, and wherein the weights that are coupled to be barbell rest on the receiving regions of the base member, with the barbell being spaced apart from the base member to permit access to the barbell so that the barbell may be grasped and lifted.

13. A system as in claim 12, wherein the coupling mechanism comprises a pair of arms slidably received into a pair of slots in the base member.

14. A system as in claim 13, wherein each arm includes a hole, and wherein the barbell is received in the holes.

15. A system as in claim 14, wherein the barbell comprises a handle and a pair of end pieces, and wherein the handle is disposed between the arms and the end pieces are inserted through the holes and into the handle.

16. A system as in claim 13, wherein each arm includes a ridge, wherein each slot includes a stop, and wherein the stops engage the ridges to prevent further upward travel of the arms relative to the base member.

17. A system as in claim 12, further comprising a weight removably held on the shelf.

18. A system as in claim 17, further comprising a securing mechanism to removably secure the weight to the shelf.

19. A portable barbell holding system, comprising:

a barbell;

a base member having a bottom end, a top end, and at least one shelf;

a pair of arms operably attached to the base member so as to extend above the top end, wherein the barbell is removably coupled to the pair of arms so as to be positioned on or above the top end to permit generally unobstructed access to the barbell from above the top end when grasping the barbell, and to permit the barbell and base member to be lifted together; and a weight removably held on the shelf.

* * * * *